US011176906B2

(12) United States Patent
Aubineau et al.

(10) Patent No.: US 11,176,906 B2
(45) Date of Patent: Nov. 16, 2021

(54) SYSTEM AND METHOD TO IDENTIFY A SERIAL DISPLAY INTERFACE MALFUNCTION AND PROVIDE REMEDIATION

(71) Applicant: NXP B.V., Eindhoven (NL)

(72) Inventors: Vincent Aubineau, Boulogne Billancourt (FR); Michael Andreas Staudenmaier, Munich (DE); Adrian Victor Raileanu, Montigny le Bretonneux (FR)

(73) Assignee: NXP B.V., Eindhoven (NL)

( * ) Notice: Subject to any disclaimer, the term of this patent is extended or adjusted under 35 U.S.C. 154(b) by 31 days.

(21) Appl. No.: 16/118,246

(22) Filed: Aug. 30, 2018

(65) Prior Publication Data

US 2019/0362687 A1 Nov. 28, 2019

(30) Foreign Application Priority Data

May 24, 2018 (EP) ..... 8305633

(51) Int. Cl.
*G09G 5/00* (2006.01)

(52) U.S. Cl.
CPC ..... *G09G 5/006* (2013.01); *G09G 2320/0666* (2013.01); *G09G 2330/08* (2013.01); *G09G 2330/12* (2013.01); *G09G 2340/0421* (2013.01); *G09G 2370/14* (2013.01)

(58) Field of Classification Search
CPC ..... G09G 2370/14; G09G 5/006; G09G 2330/12; G09G 2330/08; G09G 2340/0421; G09G 2320/0666
See application file for complete search history.

(56) References Cited

U.S. PATENT DOCUMENTS

| | | | | |
|---|---|---|---|---|
| 7,035,290 | B1 * | 4/2006 | Lyle | G09G 5/006 370/465 |
| 7,558,326 | B1 * | 7/2009 | Lyle | H04L 1/0057 348/469 |
| 9,205,743 | B2 | 12/2015 | Rahe et al. | |
| 2003/0128198 | A1 * | 7/2003 | Mizuyabu | G06F 1/3203 345/204 |
| 2006/0279519 | A1 * | 12/2006 | Wang | G09G 5/006 345/102 |
| 2010/0014620 | A1 | 1/2010 | Albu et al. | |
| 2013/0113777 | A1 * | 5/2013 | Baek | G09G 3/20 345/212 |
| 2013/0235039 | A1 * | 9/2013 | Montag | G09G 5/006 345/428 |
| 2019/0043430 | A1 * | 2/2019 | Jung | G09G 3/3291 |

* cited by examiner

*Primary Examiner* — Samantha (Yuehan) Wang

(57) ABSTRACT

A system includes a video generation circuit (102) to generate first graphics information, a display circuit (112) to display the graphics information, and a low voltage differential signaling (LVDS) (120) video interface to couple graphics information from the video generation circuit to the display circuit. The display circuit can determine that a first channel (204) of the LVDS video interface is corrupted. In response, the display circuit provides a remediation signal (205) to direct the video generation circuit (102) to operate in an alternative operating mode (208).

17 Claims, 6 Drawing Sheets

SYSTEM AND METHOD TO IDENTIFY A SERIAL DISPLAY INTERFACE MALFUNCTION AND PROVIDE REMEDIATION

CROSS-REFERENCE TO RELATED APPLICATION(S)

The present application claims priority to European Application No. EP 18305633.2, entitled "SYSTEM AND METHOD TO IDENTIFY A SERIAL DISPLAY INTERFACE MALFUNCTION AND PROVIDE REMEDIATION" filed on May 24, 2018, the entirety of which is herein incorporated by reference.

FIELD OF THE DISCLOSURE

This disclosure relates generally to electronics, and more particularly to integrated circuits.

BACKGROUND

Display devices are ubiquitous with many electronic devices. Today, cathode-ray tube displays have been replaced by digital flat-flat panel displays, such as liquid crystal display (LCD) devices. Various display interface standards are currently in use, including Digital Visual Interface (DVI), High-Definition Multimedia Interface (HDMI), Display Port, FPD_Link, and the like. FPD-Link is one of the earliest digital display interface standards and is still in use today. FPD-Link utilizes a low voltage differential signaling (LVDS) technology, and provides the basis for the OpenLDI standard. OpenLDI is a high-bandwidth digital-video interface standard for connecting graphics/video processors to flat panel LCD monitors. Even though the promoter's group originally designed OpenLDI for the desktop computer to monitor application, the majority of applications today are industrial display connections. For example, automotive infotainment displays for automobile navigation systems started using FPD-Link in 2001.

The automotive environment is known to be one of the harshest environments for electronic equipment due to inherent extreme temperatures, vibration, and electrical transients. The OpenLDI interface is widely used in the automotive environment. The purpose of the OpenLDI specification is to provide for the transfer of digital display data between a display source and a display device, avoiding the conversion of the display data into analog form with its resultant loss of information. Additionally, the OpenLDI specification describes a signaling mechanism that minimizes the number of wires that must be used to connect the display source and display device, as well as minimizes electromagnetic emissions. The interface provides the flexibility to support a wide range of display formats, refresh rates, and pixel depths. The OpenLDI standard also describes an electrical interface that enables the transmission of the pixel, synchronization and control information using a minimum number of conductors.

Display information in digital systems is represented in pixels. Each pixel represents a single, tiny element of the information to be displayed. By combining a large number of individual pixels, displays of any size may be created. The size of a display is measured in the number of pixels contained in one horizontal row and the number of rows that are stacked vertically. Thus, a display that is 640 pixels wide and 480 rows tall is said to be a 640×480 display and contains 307,200 pixels. In digital systems, each pixel is a binary encoding of color intensity. The number of bits used to encode this information is often referred to as the color depth or color resolution. Monochrome systems often use a single byte to encode each pixel, resulting in a total of 256 available shades. Color systems commonly use 18 or 24 bits to encode each pixel, resulting in 262,144 or 16,777,216 colors. Pixels are usually stored in the display source in a memory called a frame buffer. The pixels are stored in parallel format and sent out serially to the display device.

LVDS is a general-purpose, unidirectional digital data connection. LVDS involves serialization of the input data, distributing the input data among multiple serial differential pairs, and transmitting the data at a clock rate several times the original pixel frequency. The pixel clock is also transmitted via a separate differential pair. All pairs, both data and clock, operate in a true voltage-differential mode. An LVDS receiver accepts the data and clock pairs, uses the clock to both deserialize the data and to regenerate the original-rate pixel clock, and provides the video data, control signals, and clock as separated outputs

BRIEF DESCRIPTION OF THE DRAWINGS

The present disclosure may be better understood, and its numerous features and advantages made apparent to those skilled in the art by referencing the accompanying drawings.

The use of the same reference symbols in different drawings indicates similar or identical items

DETAILED DESCRIPTION OF THE DRAWINGS

A video display interface typically includes multiple serial channels to couple video and other information between a video source and a video display device. A failure of one or more channels can result in partial or complete corruption of video information provided to the display device. For clarity, techniques disclosed herein are described in the context of an OpenLDI compliant video display system, however one of skill will appreciate that these techniques are applicable to any multichannel serial interface technology.

An OpenLDI compliant video display system includes an LVDS transmitter and receiver. The input signals to the transmitter at the display source include pixel data, horizontal synchronization, vertical synchronization, a data enable control, the pixel clock, and two miscellaneous control signals. These signals are serialized and transmitted over LVDS differential pairs. At the display device the LVDS signals are received, converted to parallel form and output from the receiver. If one or more of the LVDS differential pairs is damaged, for example by a short circuit or an open circuit, the image being transferred is corrupted. Much of the information displayed at an automotive video display system pertains to safety, such as vehicle camera images, navigation and mapping systems, maintenance and fault warnings, and the like. Accordingly, corruption of the video display caused by a fault in the LVDS transceiver system can have dangerous ramifications. The present disclosure provides techniques to prevent a situation where a malfunctioning LVDS differential pair results in the entire video connection becoming unusable. In particular, these techniques include detecting that there is a problem with the LVDS link, and providing remediation by transitioning to an operating mode that does not use the malfunctioning LVDS differential pair. For example, the video display system can transition operation to a degraded mode having reduced color depth, decreased horizontal resolution, and the like. While these techniques are described in the context of an automotive video display system, the various embodiments disclosed below can be utilized in any video display application that includes an LVDS interface.

Figure 1:
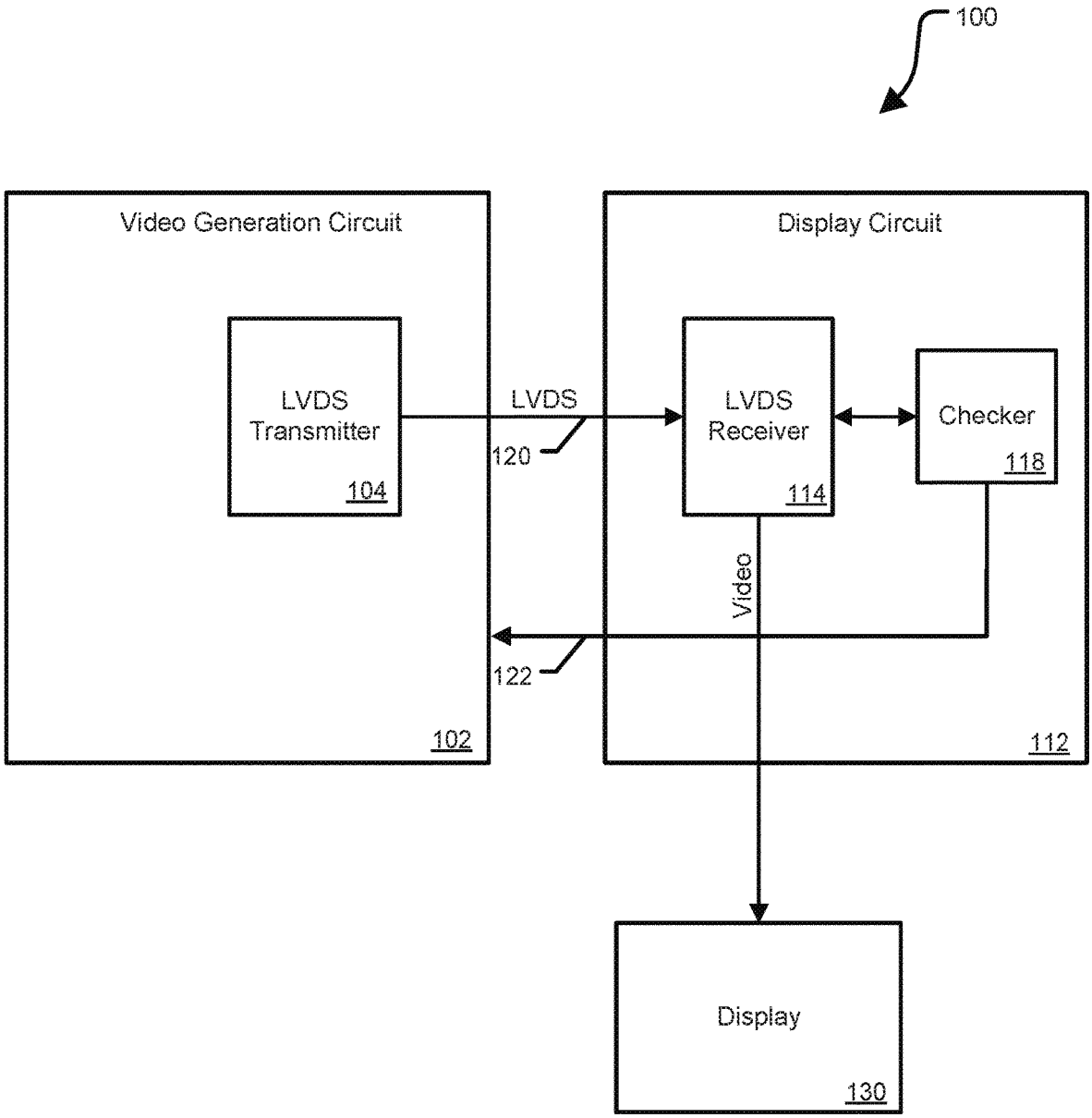
FIG. 1 is a block diagram illustrating a video display system according to a specific embodiment of the present disclosure.

FIG. 1 is a block diagram illustrating a video display system 100 according to a specific embodiment of the present disclosure. System 100 includes a video generation circuit 102, a display circuit 112, and a display device 130. For example, video generation circuit 102 can represent an automotive infotainment unit, and display circuit 112 can represent an automotive instrument cluster screen. Video generation circuit 102 includes an LVDS transmitter 104, and display circuit 112 includes an LVDS receiver 114 and a link checker 118. An LVDS link 120 couples video information and associated control signals from transmitter 104 to receiver 114, and a backchannel interconnect 122 supports transmission of remediation information from link checker 118 to video generation circuit 102. LVDS link 120 includes a plurality of differential signal pairs, also referred to herein as channels. During operation, LVDS transmitter 104 receives red, green, and blue (RGB) color information corresponding to each pixel to be displayed, horizontal and vertical sync signals, a pixel clock, a data enable signal, and control information. LVDS transmitter 104 is configured to serialize and transmit the received information over some or all of the LVDS link channels. LVDS receiver 114 is configured to deserialize the information transferred via LVDS link 120 and provide the reconstructed video image to display device 130. Backchannel interconnect 122 can include a control area network (CAN) or another type of serial or parallel data communication interface. Display device 130 can include a liquid crystal display, an organic light-emitting diode (OLED) display, a plasma display, and the like.

During operation, link checker 118 is configured to identify one or more types of link failure, select an appropriate remediation plan, and communicate the remediate plan to video generation circuit 102. In response, video generation circuit 102 reconfigures operation according to the remediation plan. For example, link checker 118 may identify that an LVDS channel is no longer functional, and a remediation plan can include reconfiguring transmitter 104 and receiver 114 to utilize another link channel to carry the information previous associated with the failed link channel. In an embodiment, display circuit 112, and link checker 118 in particular, can monitor the timings of one or more of a vertical synchronization, a horizontal synchronization, or a pixel clock signal to determine if these signals are operating according to specifications. If the signal timing is incorrect, a remediation notification and plan can be provided to video generation circuit 102.

A remediation plan may include reducing the color depth of video information transmitted over LVDS link 120. For example, under normal operating conditions video display system 100 may operate in a twenty-four bit dual pixel balanced mode that utilizes eight color data channels and two clock channels of LVDS link 120. In the event that that link checker 118 identifies a fault on one of the LVDS interface channels, checker 118 can send a remediation message to video generation circuit 102 requesting that circuit 102 transition to an operating mode that does not use the defective channel. A remediation signal is also provided to the receiver circuitry so that the receiver can transition operation to the alternative operating mode. For example, system 100 can transition to operating in an eighteen bit dual pixel balanced mode that requires one less link channel. In an embodiment, LVDS transmitter 104 and receiver 114 can include multiplexors, not shown in FIG. 1, which can remap which LVDS channels are associated with a particular LVDS data stream. Numerous fault detection and remediation techniques are described below with reference to FIGS. 2-6.

Figure 2:
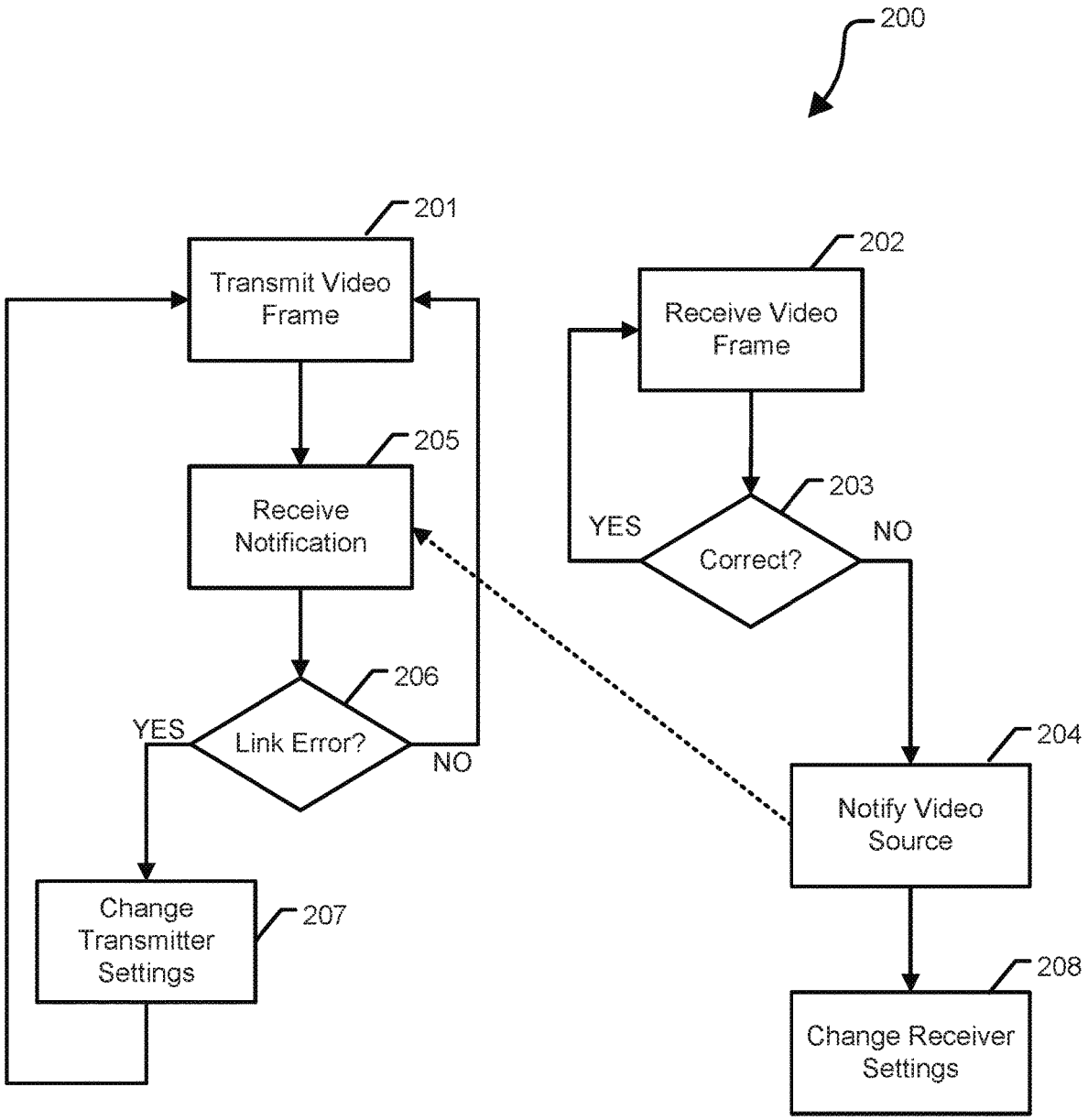
FIG. 2 is a flow diagram illustrating a method for detecting a link failure and providing remediation at a video display system according to a specific embodiment of the present disclosure.

FIG. 2 is a flow diagram illustrating a method 200 for detecting a link failure and providing remediation at video display system 100 according to a specific embodiment of the present disclosure. Method 200 begins at block 201 where a video frame is transmitted over an LVDS interface. At block 202, the video frame is received. For example, LVDS transmitter 104 at video generation circuit 102 may send video information to display circuit 112 via LVDS interface 120. Method 200 continues at decision block 203 where it is determined whether the video information was received without error. If no errors are detected, method 200 returns to block 202 where additional video frames are received, and subsequently validated. If however an error is detected at decision block 203, the method continues at block 204 where the video generation circuit is notified of the error and provided with a remediation plan, as indicated by block 205. If no error is detected, video generation circuit proceeds to transmit another video frame. If an error notification is received, method 200 proceeds from decision block 206 to block 207 where LVDS transmitter 104 is reconfigured according to the remediation plan, and subsequent video information is transmitted according to the plan. Method 200 completes at block 208, where LVDS receiver 114 is reconfigured to operating according to the remediation plan.

In an embodiment, a remediation plan can include reducing the number of LVDS data channels that are required by reducing a color depth of transmitted video, as described above. In another embodiment, the remediation plan can include reducing the horizontal resolution of video transmitted over LVDS interface 120. For example, link checker 118 can determine that a failure of one or more LVDS channels or corresponding physical layer circuitry prevents reliable transmission at a desired frequency, and the remediation plan can call for reducing the rate that pixel information is transmitted. Accordingly, clock recovery may be required to increase the frequency of the received pixel clock to remain compatible with the pixel resolution of display device 130. In addition, pixel information received at a reduced rate can be buffered and repeatedly provided to the display to provide a reduced-resolution image. Alternatively, the operating frequency of the LVDS interface can be reduced by selecting a slower display update frequency. In yet another embodiment, the remediation plan can include transitioning from a split mode of operation that utilizes two LVDS interfaces to a non-split mode of operation that utilizes only one LVDS interface. In still another embodiment, logical or physical multiplexors can reassign which LVDS channels are utilized for particular data. For example, a channel that was previously associated with color data can be used to transfer clock information in the event that the channel previously used to provide the clock signal becomes defective.

A failure at an LVDS channel may include a malfunction of a single wire of a differential pair associated with a particular LVDS channel. Accordingly, a remediation plan can include continuing to utilize the damaged LVDS channel, but operating in a single-ended mode rather than a differential mode, thereby ignoring the malfunctioning wire. In another embodiment, the remediation plan can include fully discontinuing use of LVDS interface 120 and instead transmitting video information over an alternative interface. For example, video information can be transmitted via a local interconnect network, a control area network, a universal asynchronous receiver-transmitter, and the like (not shown in FIG. 1). In still another embodiment, display circuit 112, having recognized a serious failure of LVDS interface 120, can display an error message at display 130.

Figure 3:
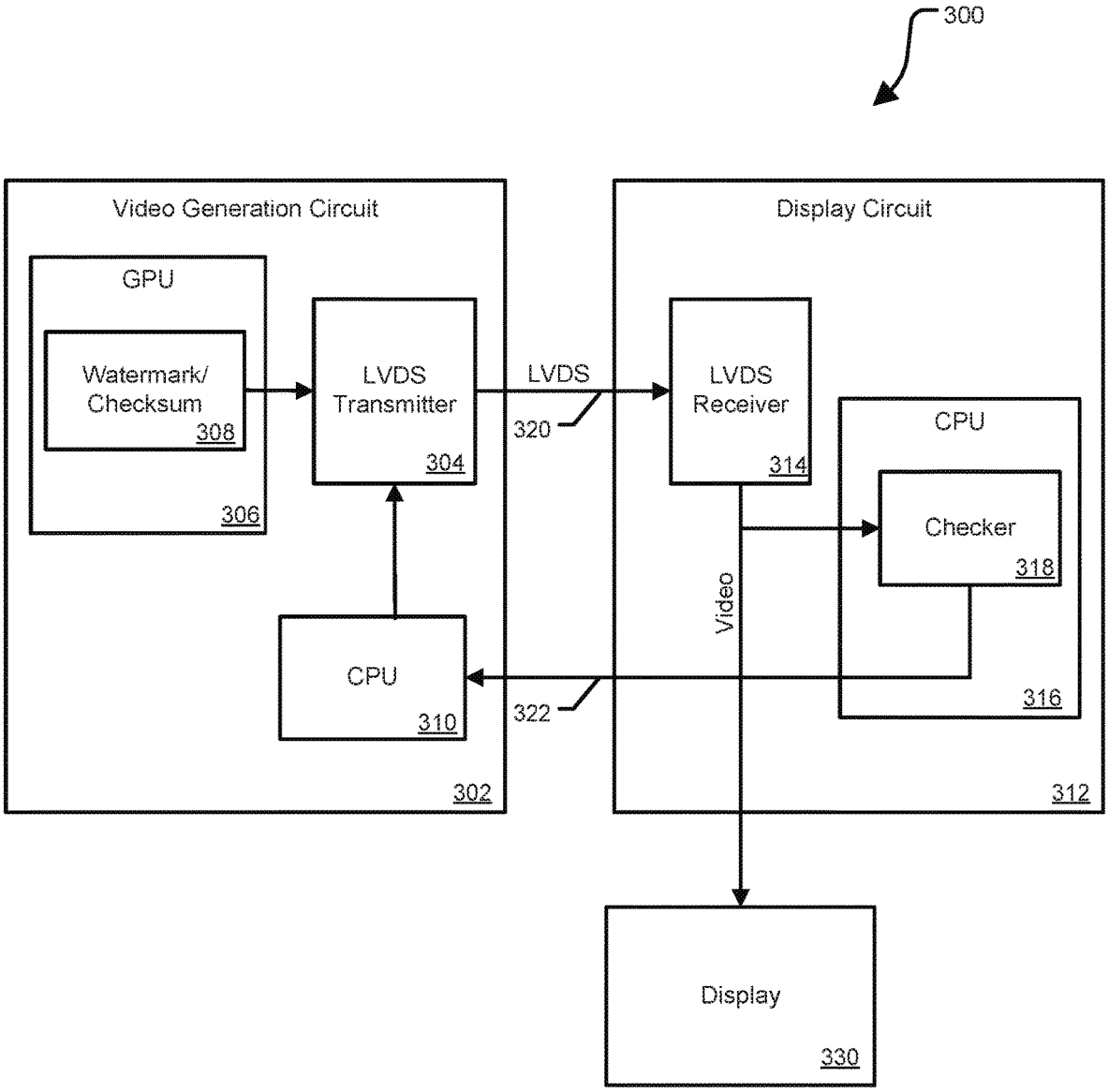
FIG. 3 is a block diagram of a video display system according to another embodiment of the present disclosure.

FIG. 3 is a block diagram of a video display system 300 according to another embodiment of the present disclosure. System 300 may represent a semi-smart remote display implementation that includes a simple microcontroller. System 300 includes a video generation circuit 302 coupled to a display circuit 312 by an LVDS interface 320 and a backchannel interface 322. Video generation circuit 302 includes an LVDS transmitter 304, a graphics processing unit (GPU) 306, and a central processing unit (CPU) 310. GPU 306 includes or otherwise implements a watermark or checksum generator 308. Display circuit 312 includes an LVDS receiver 314 and a CPU 316. CPU 318 includes or implements a link checker 318. As described above with reference to FIG. 1, link checker 318 is configured to provide a notification and remediation plan to video generation circuit 302 if one or more failures associated with LVDS interface 320 are identified. CPU 316 and CPU 310 may be configured to provide additional functionality at system 300, but can be leveraged to perform aspects of error detection and remediation.

GPU 306 is configured to generate video data to be provided to display circuit 312 for presentation at display device 330. Watermark or checksum generator 308 is configured to generate additional information to be transmitted over LVDS interface 320. In an embodiment generator 308 can provide a predetermined data value, referred to as a watermark, that can be transmitted over one or more channels of LVDS interface 320 during a horizontal or vertical blanking interval or synch gap. In a particular embodiment, the watermark or checksum information can be transmitted at a time that does not correspond to the horizontal or vertical blanking interval. For example, a portion of the display may be obscured by a display bezel or the display circuit 312 may generate display information corresponding to a portion of the display. Accordingly, the watermark or checksum information can be transmitted during a time that corresponds to when display information provided by video generation circuit 302 is not visible at display 330. Link checker 318 can be configured to verify that the watermark is received correctly by verifying that the watermark received over interface 320 matches the predetermined data value. If the watermark received at link checker 318 is correct, than the particular LVDS channel is operating properly. If the watermark received at link checker 318 differs from the predetermined data value, it can be determined that the particular LVDS channel has malfunctioned.

In another embodiment, generator 308 can calculate a checksum, a hash, a cyclic redundancy check code, and the like based on data that is transmitted via the LVDS channel. For example, link checker 318 can calculate a checksum based on data received over a particular LVDS channel and compare the calculated checksum with the checksum transmitted by LVDS transmitter 304. If the checksum calculated by link checker 318 matches the checksum provided by video generation circuit 302, than the particular LVDS channel is operating properly. If the checksum calculated by link checker 318 differs from the value received at LVDS receiver 314, it can be determined that the particular LVDS channel has malfunctioned.

Figure 4:
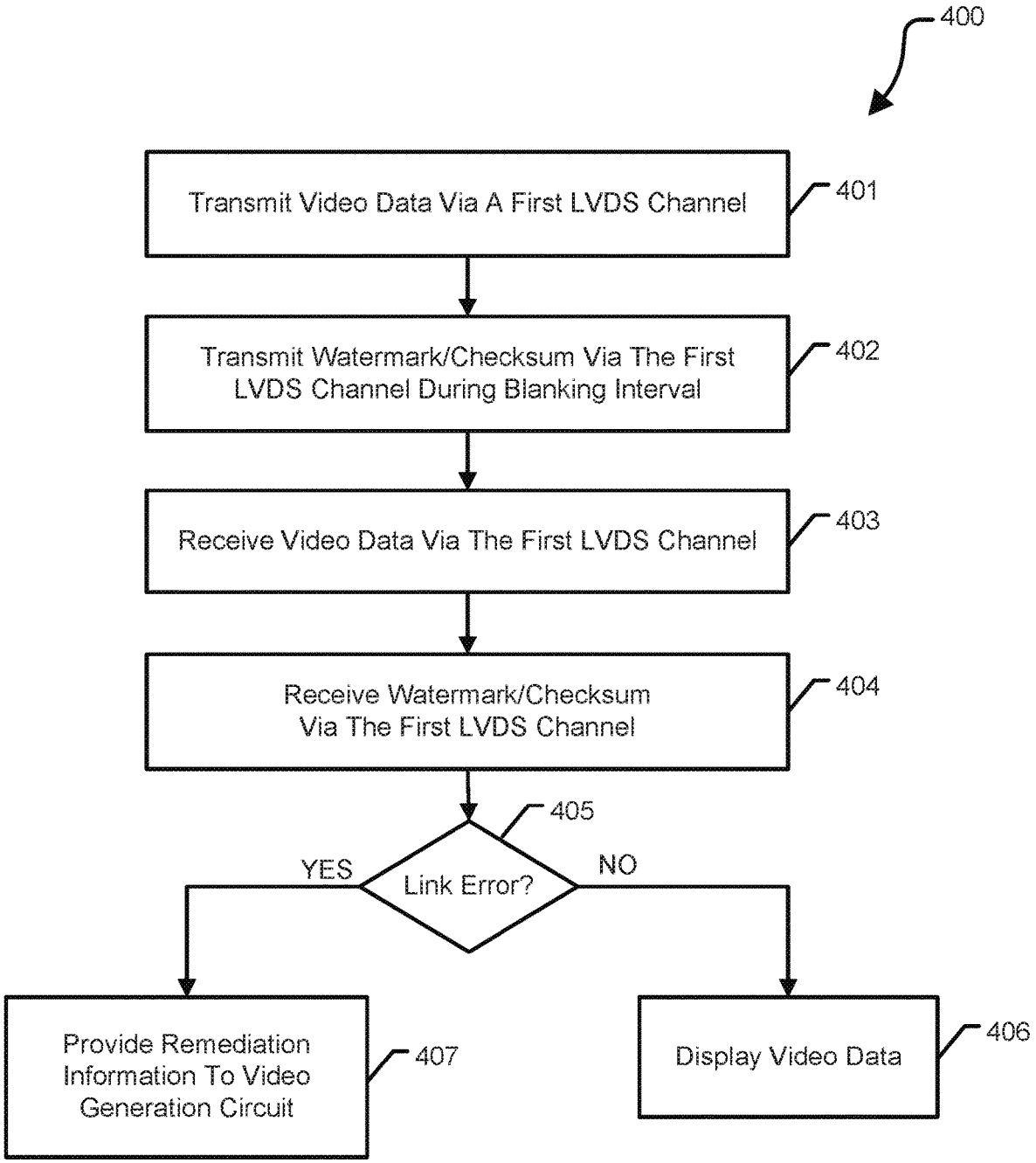
FIG. 4 is a flow diagram illustrating a method for identifying a link failure according to a specific embodiment of the present disclosure.

FIG. 4 is a flow diagram illustrating a method 400 according to a specific embodiment of the present disclosure. Method 400 begins at block 401 where video data is transmitted via a first LVDS channel. At block 402, a watermark or checksum is transmitted via the first LVDS channel during one or both of a horizontal or a vertical blanking interval. For example, LVDS transmitter 304 can transmit a checksum on each channel of LVDS interface 320 during a horizontal blanking interval or during a vertical blanking interval. The checksum associated with each LVDS channel can be determined by generator 308 based on a data transferred on each corresponding channel following the previous horizontal blanking interval. At block 403, the transmitted video data that was transmitted over the first LVDS channel is received at LVDS receiver 314, and at block 404, the watermark or checksum information is received. At decision block 405, it is determined whether a link error has occurred based on the received video data and watermark or checksum. For example, link checker 318 can verify that a received watermark matches a predetermined value that was transmitted at block 402. Alternatively, link checker 318 can calculate a checksum based on the video data transmitted at block 401 and verify that the calculated checksum matches the checksum value received at block 404.

In an embodiment, a respective watermark or checksum can be simultaneously provided on every channel of LVDS interface 320, for example corresponding to each horizontal video scan line. Alternatively, the watermark or checksum information can be transmitted over a single LVDS channel during a first horizontal video scan line, and over each additional channel in a sequential manner during successive scans lines. Similarly, a watermark or checksum can be provided simultaneously on every channel of LVDS interface 320 during a vertical blanking interval. Alternatively, a watermark or checksum can be transmitted over a single LVDS channel for one video frame and over additional channels in a sequential manner during successive video frames. Returning to decision block 405, if no error is detected based on the received watermark or checksum, method 400 proceeds to block 406 where the transmitted video data can be displayed. If an error is detected, a remediation notification and remediation plan can be provided to CPU 310 at video generation circuit 302, and video display system 300 can proceed to operate according to the remediation plan. As described above, the remediation plan can include a so-called degraded mode of operation that does not utilize an LVDS channel identified as corrupted based on the evaluation performed by link checker 318.

Figure 5:
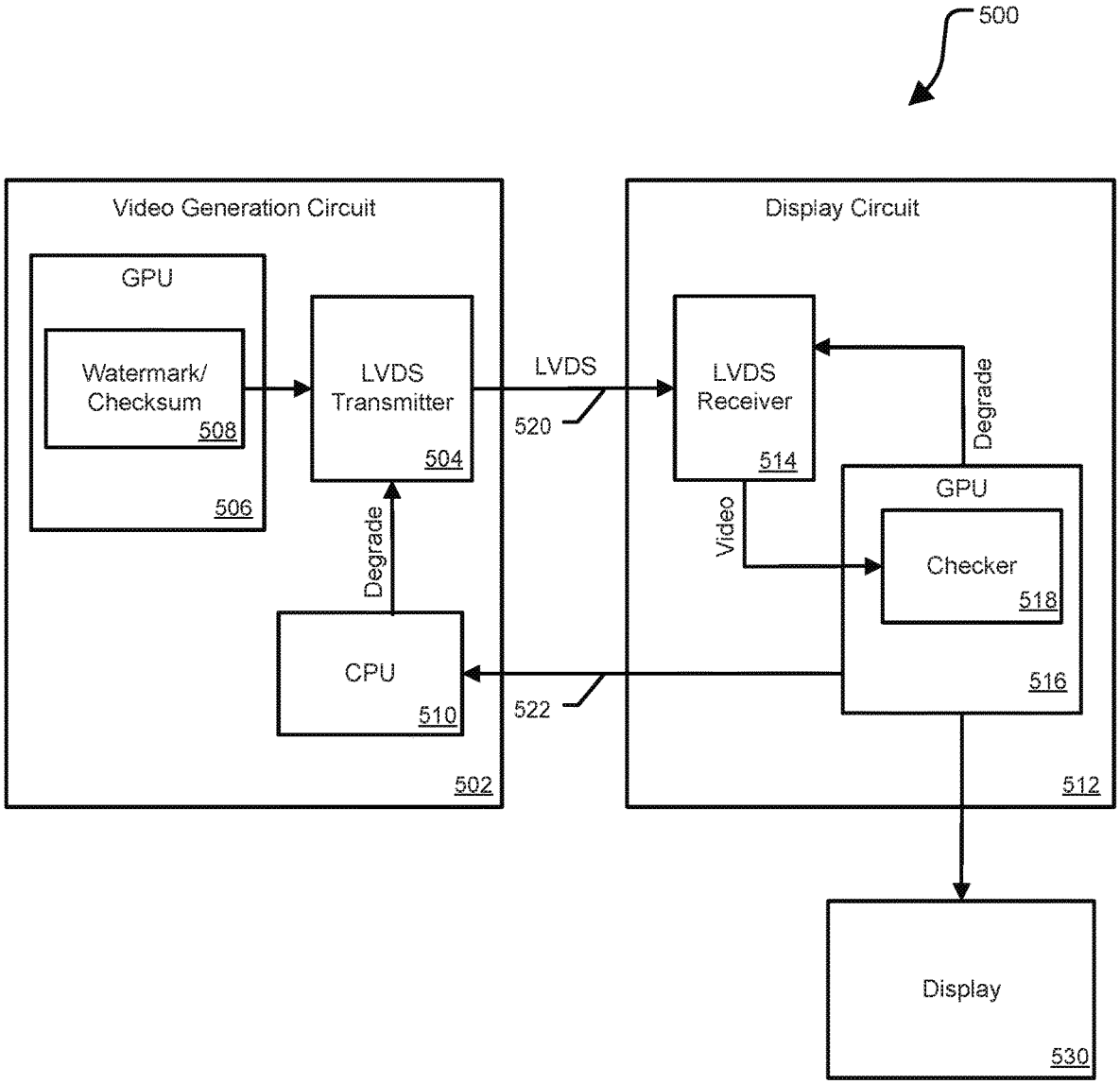
FIG. 5 is a block diagram of a video display system according to yet another embodiment of the present disclosure.

FIG. 5 is a block diagram of a video display system 500 according to yet another embodiment of the present disclosure. System 500 may represent a so-called smart remote display implementation that is operable to further modify or augment video information received from a video source. System 500 includes a video generation circuit 502 coupled to a display circuit 512 by an LVDS interface 520 and a backchannel interface 522. Video generation circuit 502 includes an LVDS transmitter 504, a GPU 506, and a CPU 510. GPU 506 includes or otherwise implements a watermark or checksum generator 508. Display circuit 512 includes an LVDS receiver 514 and a GPU 516. GPU 516 includes or implements a link checker 518. As described above with reference to FIG. 1, link checker 518 is configured to provide a notification and remediation plan to video generation circuit 502 if one or more failures associated with LVDS interface 520 are identified. GPU 506 is configured to provide video data to display device 530. For example, display device 530 can be configured to operate in a split mode having two display partitions, a first partition for displaying information received from video generation circuit 502, and a second partition for displaying information originating at display circuit 512. For another example, display device 530 can be configured to display video information received from video generation circuit 502, with additional information superimposed on the display that is provided by display circuit 512.

Figure 6:
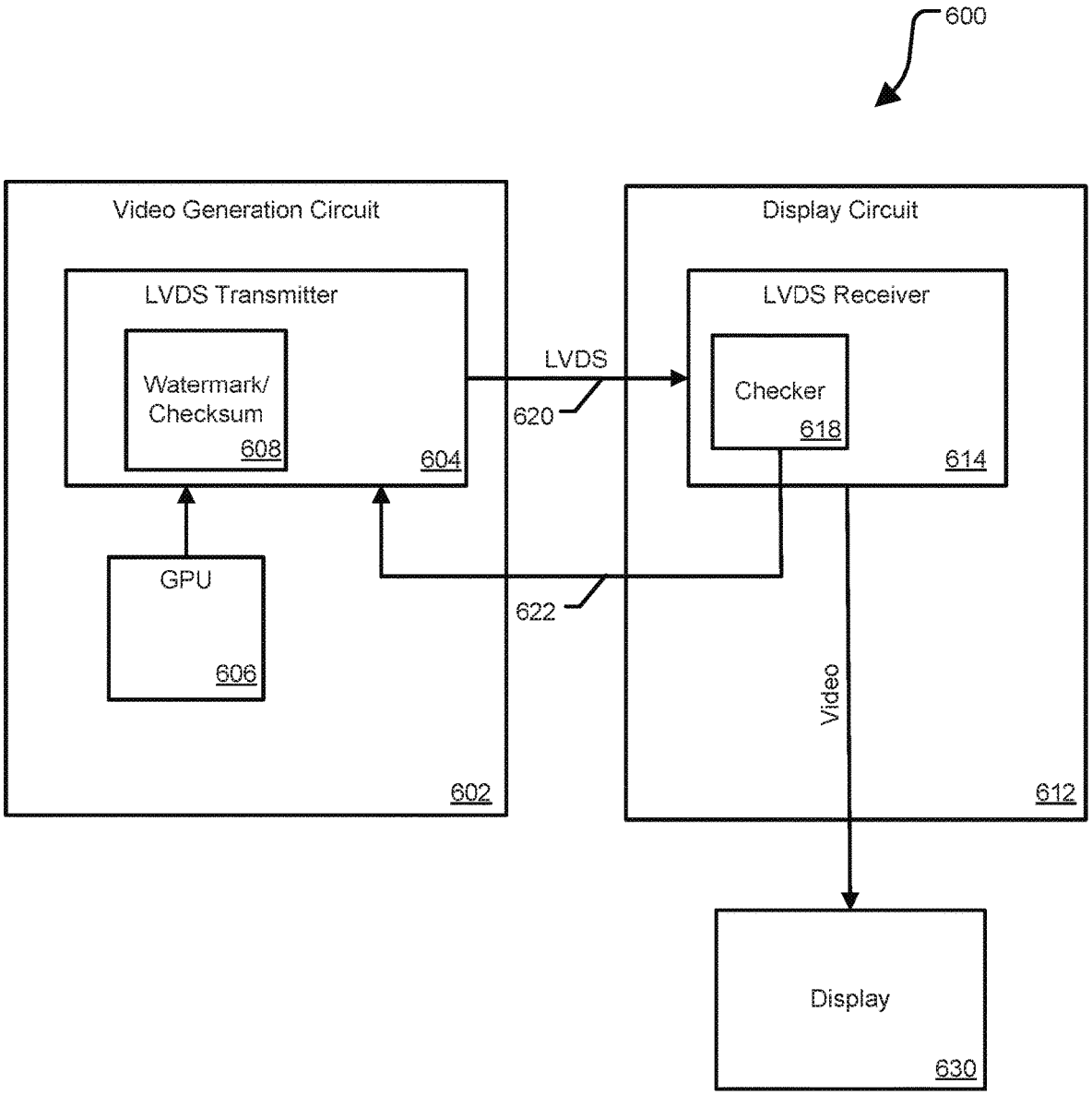
FIG. 6 is a block diagram of a video display system according to still another embodiment of the present disclosure.

FIG. 6 is a block diagram of a video display system 600 according to still another embodiment of the present disclosure. System 600 may represent a so-called dumb remote display and a smart LVDS transceiver implementation that is operable to further modify or augment video information received from a video source. System 600 can include proprietary LVDS transceiver integrated circuits that incorporate the error detection protocols. System 600 includes a video generation circuit 602 coupled to a display circuit 612 by an LVDS interface 620 and a backchannel interface 622. Video generation circuit 602 includes an LVDS transmitter 604, and a GPU 606. LVDS transmitter 604 includes a watermark/checksum generator 608. Display circuit 612 includes an LVDS receiver 614. LVDS receiver 614 includes a link checker 618. As described above with reference to FIG. 1, link checker 618 is configured to provide a notification and remediation plan to LVDS transmitter 604 if one or more failures associated with LVDS interface 620 are identified by link checker 618. The video display systems illustrated at FIGS. 1, 5, and 6 are examples of how the techniques disclosed herein can be implemented on a variety of different video system implementations. One of skill will appreciate that other computational resources that may be available at a video display system, including CPUs, GPUs, and custom circuitry, can be adapted to implement link validation and remediation as disclosed above.

As used herein, the terms "substantial" and "substantially" mean sufficient to achieve the stated purpose or value in a practical manner, taking into account any minor imperfections or deviations, if any, that arise from usual and expected abnormalities that may occur during device operation, which are not significant for the stated purpose or value.

The preceding description in combination with the Figures was provided to assist in understanding the teachings disclosed herein. The discussion focused on specific implementations and embodiments of the teachings. This focus was provided to assist in describing the teachings, and should not be interpreted as a limitation on the scope or applicability of the teachings. However, other teachings can certainly be used in this application. The teachings can also be used in other applications, and with several different types of architectures.

In this document, relational terms such as "first" and "second", and the like, may be used solely to distinguish one entity or action from another entity or action without necessarily requiring or implying any actual such relationship or order between such entities or actions. The terms "comprises", "comprising", or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element.

Other embodiments, uses, and advantages of the disclosure will be apparent to those skilled in the art from consideration of the specification and practice of the disclosure disclosed herein. The specification and drawings should be considered exemplary only, and the scope of the disclosure is accordingly intended to be limited only by the following claims and equivalents thereof.

Note that not all of the activities or elements described above in the general description are required, that a portion of a specific activity or device may not be required, and that one or more further activities may be performed, or elements included, in addition to those described. Still further, the order in which activities are listed is not necessarily the order in which they are performed.

Also, the concepts have been described with reference to specific embodiments. However, one of ordinary skill in the art appreciates that various modifications and changes can be made without departing from the scope of the present disclosure as set forth in the claims below. Accordingly, the specification and figures are to be regarded in an illustrative rather than a restrictive sense, and all such modifications are intended to be included within the scope of the present disclosure.

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

What is claimed is:

1. A method comprising:

determining, during normal operating conditions, at a display circuit that a video frame received over a first channel of a low voltage differential signaling (LVDS) video interface is corrupted, wherein the video interface is configured to couple video information from a video generation circuit to the display circuit, the video interface is operating in a first operating mode, and the first operating mode utilizes a first set of one or more channels of the LVDS video interface that includes the first channel of the LVDS video interface; and in response to the determining that the video frame received over the first channel of the LVDS video interface is corrupted:

identifying a second operating mode, wherein the second operating mode utilizes a second set of the one or more channels of the LVDS video interface that does not include the first channel of the LVDS video interface, providing, by the display circuit, a remediation signal to the video generation circuit, wherein the remediation signal directs the video generation circuit to transition operation to the second operating mode, and transitioning operation of the display circuit to the second operating mode.

2. The method of claim 1, further comprising:

providing first information to be transmitted over the first channel of the LVDS video interface during a blanking interval; and determining at the display circuit that the first channel of the LVDS video interface is corrupted based on an analysis of the first information.

3. The method of claim 1, wherein the second operating mode provides less color depth than the first operating mode.

4. The method of claim 1, wherein the second operating mode utilizes a second LVDS channel to communicate information previously communicated by the first channel.

5. The method of claim 1, wherein the second operating mode utilizes only one of two differential signal paths of the first channel.

6. The method of claim 1, wherein a display update frequency associated with the second operating mode is less than the display update frequency associated with the first operating mode.

7. The method of claim 1, wherein the second operating mode does not utilize the LVDS interface and instead communicates information to be displayed by the display circuit via an alternative communications medium.

8. The method of claim 1, wherein the first operating mode is a split mode and the second operating mode is not the split mode.

9. The method of claim 1, wherein the second operating mode provides reduced horizontal resolution compared to the first operating mode.

10. The method of claim 1, wherein:

the first information includes a first predetermined value; and the analysis of the first information determines that the first predetermined value is not properly received.

11. The method of claim 1, wherein:

the first information includes a checksum generated based on image data transmitted via the first channel.

12. A system comprising:

a video generation circuit to generate first graphics information;

a display circuit to display the graphics information; and a low voltage differential signaling (LVDS) video interface to couple graphics information from the video generation circuit to the display circuit, the display circuit configured to:

determine, during normal operation, that a video frame received over a first channel of the LVDS video interface is corrupted, the video interface operating in a first operating mode, wherein the first operating mode utilizes a first set of one or more channels of the LVDS video interface that includes the first channel of the LVDS video interface, identify a second operating mode, in response to the determining, wherein the second operating mode utilizes a second set of the one or more channels of the LVDS video interface that does not include the first channel of the LVDS video interface, provide a remediation signal to the video generation circuit, wherein the remediation signal directs the video generation circuit to operate in the second operating mode, and transition operation to the second operating mode.

13. The system of claim 12, wherein:

the video generation circuit is further configured to transmit first diagnostic information over the first channel of the LVDS video interface during a blanking interval; and the display circuit is further configured to determine that the first channel of the LVDS video interface is corrupted based on an analysis of the first diagnostic information.

14. The system of claim 12, wherein the second operating mode provides less color depth than the first operating mode.

15. The system of claim 12, wherein the second operating mode utilizes a second LVDS channel to communicate information previously communicated by the first channel.

16. An automotive information display system comprising:

a graphics generation system including a low voltage differential signaling (LVDS) transmitter;

a graphics display system including an LVDS receiver; and an LVDS video interface to couple graphics information from the LVDS transmitter to the LVDS receiver, the graphics display system configured to:

determine, during normal operation, that a video frame received over a first channel of the LVDS video interface is corrupted, the video interface operating in a first operating mode wherein the first operating mode utilizes a first set of one or more channels of the LVDS video interface that includes the first channel of the LVDS video interface, identify a second operating mode wherein the second operating mode utilizes a second set of the one or more channels of the LVDS video interface that does not include the first channel of the LVDS video interface, provide a remediation signal to the graphics generation system wherein the remediation signal directs the graphics generation system to operate in the second operating mode, and transition operation to the second operating mode.

17. The automotive information display system of claim 16, wherein:

the graphics generation system is further configured to transmit first diagnostic information over the first channel of the LVDS video interface during a blanking interval; and the display system is further configured to determine that the first channel of the LVDS video interface is corrupted based on an analysis of the first diagnostic information.

* * * * *